US007927044B2

(12) United States Patent
Craig et al.

(10) Patent No.: US 7,927,044 B2
(45) Date of Patent: Apr. 19, 2011

(54) TENSIONING ASSEMBLY FOR A CABLE BOLT

(75) Inventors: Peter Harold Craig, Cooyal (AU); Timothy Joseph Gaudry, Picton (AU)

(73) Assignee: FCI Holdings Delaware, Inc., Wilmington, DE (US)

( * ) Notice: Subject to any disclaimer, the term of this patent is extended or adjusted under 35 U.S.C. 154(b) by 60 days.

(21) Appl. No.: 12/023,198

(22) Filed: Jan. 31, 2008

(65) Prior Publication Data

US 2008/0179575 A1 Jul. 31, 2008

(30) Foreign Application Priority Data

Jan. 31, 2007 (AU) ..... 2007900450

(51) Int. Cl.
*E21D 21/00* (2006.01)
*E21D 20/02* (2006.01)

(52) U.S. Cl. ..... 405/259.6; 405/259.1

(58) Field of Classification Search ..... 411/4, 5, 411/14.5, 82, 916, 392, 82.1, 82.3, 432, 433, 411/917, 354, 35, 265; 405/259.1, 259.4, 405/259.5, 259.6
See application file for complete search history.

(56) References Cited

U.S. PATENT DOCUMENTS 3,191,486 A * 6/1965 Gibbens ..... 411/4
4,347,020 A * 8/1982 White et al. ..... 405/259.5
5,259,703 A * 11/1993 Gillespie ..... 405/259.6
6,270,290 B1 * 8/2001 Stankus et al. ..... 405/259.6

FOREIGN PATENT DOCUMENTS

JP 56153017 A * 11/1981

* cited by examiner

*Primary Examiner* — Sunil Singh
(74) *Attorney, Agent, or Firm* — The Webb Law Firm

(57) ABSTRACT

A tensioning assembly 10 for a cable bolt having a flexible shaft 12 comprises a clamping device 14, 16 configured to mount to the bolt shaft 12 with an axis (CA) of the clamping device aligned with the shaft axis (SA); and an outer member located over, and engaged with, the clamping device 14, 16. The outer member 18 is arranged, under a predetermined movement of the outer member, to impart drive to the clamping device 14, 16 to bias the clamping device 14, 16 to move in the direction of the clamping device axis. A cable bolt and method of tensioning a cable bolt is also disclosed.

26 Claims, 3 Drawing Sheets

TENSIONING ASSEMBLY FOR A CABLE BOLT

BACKGROUND OF THE INVENTION

1. Field of the Invention

The present invention relates to cable bolts and in particular to tension assemblies for cable bolts suitable for use in the mining and tunnelling industry to provide rock and wall support. The invention is suitable for use in hard rock applications as well as in softer strata, such as that often found in coal mines, and it is to be appreciated that the term "rock" as used in the specification is to be given a broad meaning to cover both these applications.

2. Description of Related Art

Roof and wall support is vital in mining and tunnelling operations. Mine and tunnel walls and roofs consist of rock strata, which must be reinforced to prevent the possibility of collapse. Rock bolts, such as rigid shaft rock bolts and flexible cable bolts are widely used for consolidating the rock strata.

In conventional strata support systems, a bore is drilled into the rock by a drill rod, which is then removed and a rock bolt is then installed in the drilled hole and secured in place typically using a resin or cement based grout. The rock bolt is tensioned which allows consolidation of the adjacent strata by placing that strata in compression.

To allow the rock bolt to be tensioned, the end of the bolt may be anchored mechanically to the rock formation by engagement of an expansion assembly on the end of bolt with the rock formation. Alternatively, the bolt may be adhesively bonded to the rock formation with a resin bonding material inserted into the bore hole. Alternatively, a combination of mechanical anchoring and resin bonding can be employed by using both an expansion assembly and resin bonding material.

When resin bonding material is used, it penetrates the surrounding rock formation to adhesively unite the rock strata and to hold firmly the rock bolt within the bore hole. Resin is typically inserted into the bore hole in the form of a two component plastic cartridge having one component containing a curable resin composition and another component containing a cuing agent (catalyst). The two component resin cartridge is inserted into the blind end of the bore hole and the mine rock bolt is inserted into the bore hole such that the end of the mine rock bolt ruptures the two component resin cartridge. Upon rotation of the mine rock bolt about its longitudinal axis, the compartments within the resin cartridge are shredded and the components are mixed. The resin mixture fills the annular area between the bore hole wall and the shaft of the mine rock bolt. The mixed resin cures and binds the mine rock bolt to the surrounding rock.

Tension assemblies have been proposed to provide tension along cable bolts, for example, which in turn provides a compressive force on the substrate, usually a mine shaft roof substrate, about the bolt. Such tension assemblies often involve hydraulic means for installation and require the installer to lift the means above chest height to be placed on the cable end exposed from the bore hole. This can lead to safety issues, depending on the mine shaft roof height. In one such assembly, with the resin set about the cable portion in the bore hole, a nut placed onto a thread cut into a portion of the outer wires of the cable bolt remaining outside the bore hole. The nut is then rotated on the cable bolt toward and to abut the substrate about the bore hole either directly or through a bearer plate disposed on the shaft between the substrate and the nut. Rotation of the nut is continued for a predetermined number of turns to provide tension along the cable. This method has been found to be unreliable in practice, with failures occurring between the nut and cable. In another method, a threaded rod is coupled onto a distal end of the cable using an external coupling. The coupling is disposed within the bore and the threaded rod is arranged to project from the bore. A plate is then disposed on the rod and a nut threadedly engaged with the rod to capture the plate. The nut is rotated on the rod such that the plate is forced onto the substrate about the bore hole. For this method to work, a portion of the bore hole, adjacent the bore hole opening, must be widened to accommodate the external coupling. This is disadvantageous in that it requires two drilling events when forming the bore hole. If the bore hole is drilled to have one diameter large enough to accommodate the fitting, a larger space is created between the bore hole wall and the cable bolt, requiring more resin to fix the cable bolt in the bore. This has been shown to reduce bond strength between the cable, resin and bore hole wall.

SUMMARY OF THE INVENTION

According to a first aspect there is provided a tensioning assembly for a cable bolt having a flexible shaft, the assembly comprising: a clamping device configured to mount to the bolt shaft, the clamping device having an axis that in use is aligned with the shaft axis; and an outer member located over, and engaged with, the clamping device, the outer member being arranged, under a predetermined movement of the outer member, to impart drive to the clamping device to bias the clamping device to move in the direction of the clamping device axis.

In one form, the outer member is engaged with the clamping device through a threaded coupling with the clamping device having a threaded portion on an external surface thereof for threaded engagement with a corresponding internal threaded surface of the outer member and wherein the predetermined movement is rotation of the outer member relative to the clamping device.

In one form, the clamping device comprises a barrel and a wedge, wherein the wedge is directly connectable to the cable bolt and the barrel is adapted to receive the wedge therein. In a particular embodiment, the wedge comprises a threaded portion on an external surface thereof for threaded engagement with a corresponding internal threaded surface of the outer member. In another form, the clamping device may be a fitting, such as a metal cylinder, that is clamped onto the shaft, for example by a swaging operation. In this form, a thread may be formed on the external surface of the cylinder for engagement with the outer member.

In one form, an abutting device is slidably mountable to the rock bolt and adapted to abut the outer member. In a particular form, the abutting device comprises a plate. The plate may comprise a central boss defining an aperture therethrough for receiving the cable bolt, the boss being configured to abut the outer member. In a particular form, the outer member is tapered from a distal end to a proximal end, the width of the aperture being smaller than a lateral width of the outer member at its distal end and larger than a lateral width of the outer member at its proximal end, the proximal end being configured to abut the boss. In one form, the proximal end of the outer member is bull-nosed. In another form, the proximal end is generally flat, and a spherical washer is disposed between the flat top of the outer member and the plate. In either form, the axis of the cable bolt is better aligned with the member to allow load to even distribute about the axis instead of causing bending. In yet another form. The proximal end of the outer member is flat and placed against a flat plate.

The outer member may comprise a drive head thereon arranged to be driven by a drive apparatus typically mounted on a drilling assembly to impart the predetermined movement on the outer member.

In a particular form, the assembly further comprising a restraining device adapted to inhibit the predetermined movement until a threshold loading is applied to the outer member. The restraining device may comprise a shear pin positionable in a bore in the outer member and clamping device and which is arranged to shear when the threshold loading is applied. Alternatively, the restraining device may comprise a cap positionable within the housing and configured to be released from the housing when a predetermined relative torque is applied between the housing and the clamping device. The torque creates the axial movement of the clamping device against the cap and the cap is released by the load imparted by this movement.

In a further aspect, there is provided a cable bolt assembly comprising a flexible cable bolt shaft and having a first end arranged in use to be anchored in a bore formed in rock strata and a second end arranged to be disposed outside the bore, and a tensioning assembly according to any form described above, wherein the clamping device of the tensioning assembly is mounted to the cable bolt shaft proximate the second end and the outer member is arranged, under the predetermined movement, to impart drive to the clamping device to bias the cable bolt shaft to move in the direction towards the second end.

According to another aspect there is provided a method of tensioning a cable bolt in a bore formed in rock strata, the cable bolt having a shaft and a first end disposed in the bore and a second end disposed outside the bore, the method comprising the steps of: providing a tension assembly on the cable bolt shaft, the tension assembly having a clamping device mounted on the shaft, and an outer member engaged with the clamping device; anchoring the cable bolt within the bore; and driving the outer member to impart a predetermined movement on the outer member, whereby under the predetermined movement, the cable bolt shaft is caused to move in a direction away from the rock strata to tension the cable by imparting drive to the clamping device to move in the direction of the axis of the cable bolt shaft towards the second end.

In one form, the method further comprises the step of causing the outer member to bear either directly or indirectly against the outer face of the rock strata. In a particular form, the outer member bears against rock strata through an abutment plate.

In one form, the clamping device is mounted to the outer member by a threaded coupling and the predetermined movement is rotation of the outer member relative to the clamping device.

In a particular form, the clamping device and the outer member rotate together until a threshold torque is applied to the tension assembly and thereafter the outer member is able to rotate relative to the clamping device.

In one form, the method further comprises the step of imparting the predetermined movement to the outer member via a drive head on the outer member.

In a particular form the cable bolt is rotated within the bore to activate anchoring of the cable bolt in the bore. In one form, the cable bolt is rotated by rotation of the outer member. In a particular form, the anchoring step comprises inserting a fixative container into the bore and inserting the second portion of the cable bolt into the bore after the container while rotating the cable bolt to fracture the container and to release a fixative substance from within the container into the space in the bore surrounding the cable bolt. Further optionally, the anchoring step further comprises the step of allowing the fixative substance to cure prior to the tensioning of the cable.

In one form, the cable bolt is provided in bore having a diameter that is less than 30% larger than the diameter of the cable bolt shaft.

BRIEF DESCRIPTION OF THE DRAWINGS

A preferred embodiment will now be described, by way of example only, with reference to the accompanying drawings in which.

BRIEF DESCRIPTION OF THE INVENTION

Referring to the Figures, a preferred embodiment is a tensioning assembly 10 for use with a cable bolt 11 for supporting walls and/or roofs of mining shafts. The assembly 10 is configured for use with cable bolts 11 which typically comprise several cabled steel wire strands wound together to form a flexible cable bolt shaft 12, however the shaft 12 may be made from other suitable materials, depending on its application. For example, the shaft 12 may be manufactured from other hard or hardened metals or polymeric materials. The shaft 12 is typically 15-281 m in diameter, where the cable diameter used may depend on the material used to form the shaft or the type of substrate in which the shaft is to be located. The length of the shaft 12 is typically in the range of about 4 m to 10 m, depending on the requirements of the user.

Figure 1:
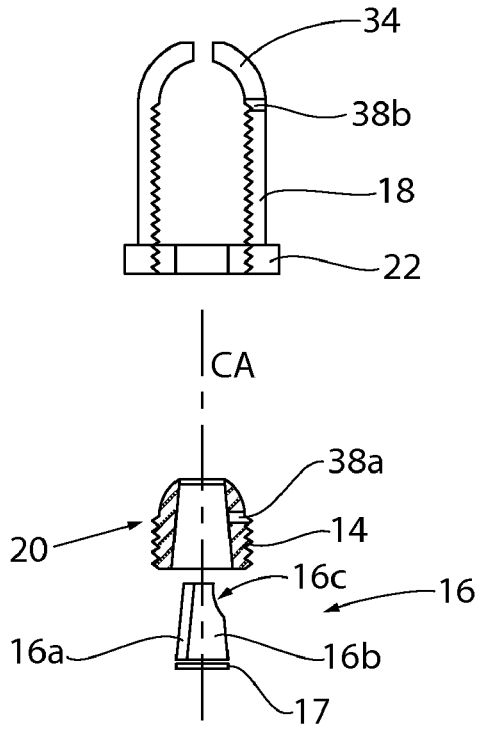
FIG. 1 illustrates a cross-sectioned exploded side elevation of a preferred embodiment of a cable bolt tensioning assembly in accordance with a preferred embodiment.
Figure 4:
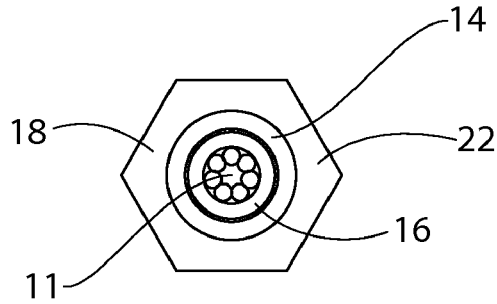
FIG. 4 is an underside view of the assembly illustrated in FIG. 1.
Figure 3:
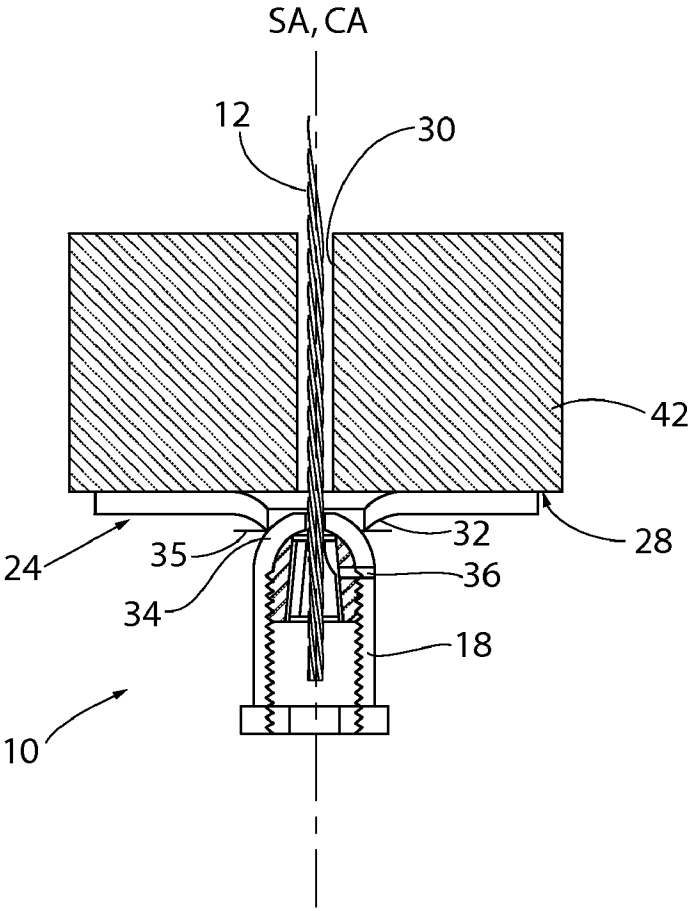
FIGS. 2 and 3 illustrate a cross-sectioned side elevation of the assembly of FIG. 1 in use in two different positions.
Figure 2:
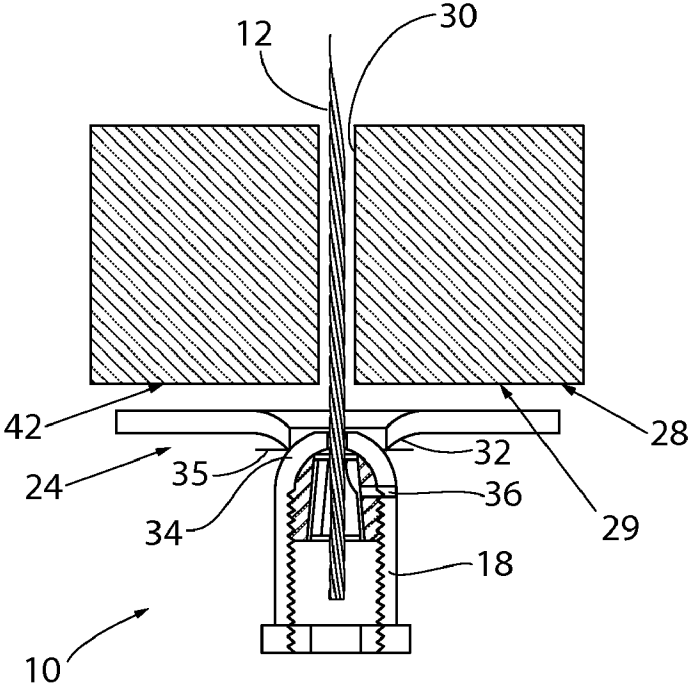

In the illustrated form, the assembly comprises a clamping device in the form of a barrel 14 and tapered wedge 16 configured to mount to the bolt shaft 12. The clamping device has an axis CA that is arranged to align with the axis SA of the bolt shaft. The wedge 16 comprises three segments 16*a,b,c* which are configured to clamp about the cable as illustrated in FIGS. 2 and 3. As will be described in more detailed below, the segments 16*a,b,c* of the wedge 16 are placed upon the cable shaft 12 and held together by a rubber o-ring 17 prior to location within the barrel 14. Alternatively, in place of the o-ring 17 a steel spring ring may be used. Also alternatively, the wedge 16 may have two segments, or more than three segments.

An outer member in the form of a housing 18 is configured for complementary threaded engagement with an outer surface 20 of the barrel 14. The housing is arranged to be secured in a plurality of positions with respect to the barrel 14 that are spaced apart in the direction of the shaft axis. The housing 18 also comprises a drive head in the form of a hexagonal drive head 22 configured to be driven by an appropriate drill rig. Alternatively, the drive head comprises slots, similar to a standard or Phillip's head screw, to receive a complementary drive mechanism. The assembly 10 further comprises an abutting device in the form of a plate 24 configured to be slidably mounted to the shaft 12 between the housing 18 and the rock strata 28. The plate 24 is configured to abut an outer rock face 29 surrounding a bore 30 in the roof 28 within which a portion of the shaft 12 is inserted. The plate 24 has a central boss 32 for receiving a portion of a rounded, tapered "bull-nosed" end 34 of the housing 18 in use. This combination of rounded end 34 and central boss 32 allows axial alignment of the boss 32 and the housing 18 in use avoiding lateral shear stresses, between the shaft 12 and the assembly 10. In an alternative embodiment, the end 34 is frustoconical in shape rather than rounded. A washer 35, typically plastic, for example high density polyethylene, is positioned on the shaft 12 between the plate 24 and the housing 18 to reduce friction therebetween when the housing 18 is rotated with respect to the plate 24. Alternatively, either in place of or in addition to the washer, the housing comprises a low friction coating (e.g., a moly-based coating) on its external surface.

Figure 5:
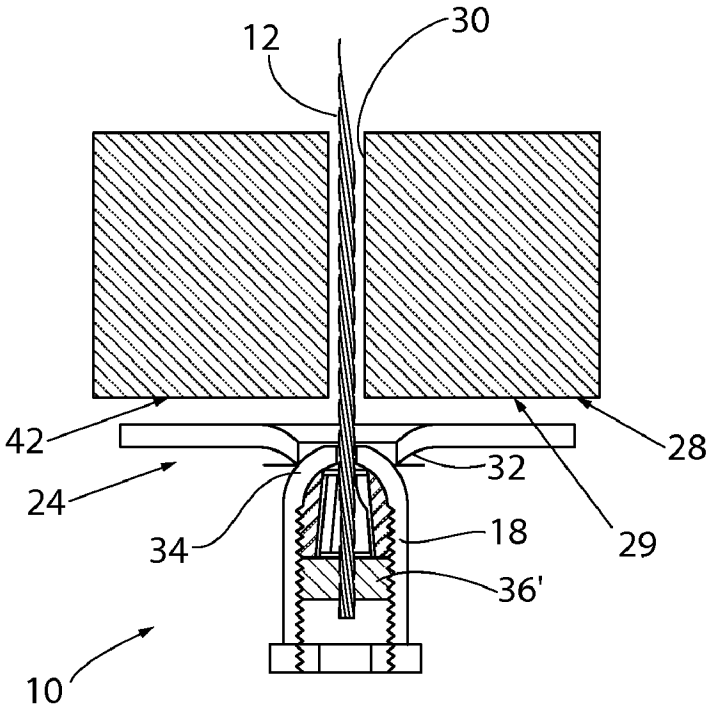
FIG. 5 illustrates a cross-sectioned side elevation of an alternative embodiment of the assembly.

The assembly 10 further comprises a restraining device in the form of a shear pin 36 locatable in a bore 38*a,b* located in both the housing 18 and the barrel 14. The shear pin 36 in the bore 38*a,b* maintains alignment of the barrel 14 within the housing 18. The shear pin 36 will break when a predetermined torque, typically 100-400 N.m, is applied relatively between the housing 18 and the barrel 14 to allow the barrel 14 to rotate within the housing. The form of the restraining device need not necessarily be in the form of a shear pin. For example, in an alternative embodiment illustrated in FIG. 5, where like reference numerals denote like parts, the restraining device is in the form of a cap 36' in the housing 18 which maintains the barrel 14 in a fixed position relative to the housing 18 until a torque applied to the housing 18 exceeds the cap's 36' strength, such that the cap 36' is expelled from the housing 18 allowing the barrel 14 to rotate relative to the housing 18. Also in this embodiment, the end 34 of the housing 18 has a low friction moly-based finish to obviate the need for the washer 35. However, if desired, the washer 35 could still be used in this embodiment.

The assembly 10 will now be described in conjunction with a method of use thereof. Firstly, the assembly 10 is assembled on the shaft 12. To do so, the wedge segments 16*a,b,c* are assembled about an end of the shaft 12 and held together with the o-ring 17. The barrel 14 is placed over the wedge 16 and the housing 18, to a position as illustrated in FIG. 2. The shear pin bore 38*a,b* is then drilled through the housing 18 and barrel 14 and the shear pin 36 placed therein.

The segments of the wedge 16 are sized so that they do not completely touch each other about the shaft 12. Therefore, the tapered nature of the wedge 16 within a complementary internal tapered bore 42 of the barrel 14 causes the wedge to clamp more tightly upon the shaft 12 when moved within the tapered bore of the barrel 14 in the direction of tapering, thus increasing the grip of the wedge 16 on the shaft 12. The angle of tapering of the internal tapered bore of the barrel in this embodiment is about 7° with respect to its axis, however in alternative embodiments, this angle of taper may be greater than or less than 7°.

A known drilling rig is provided at the surface 29 of the mine shaft roof 28. The drilling rig is used to drill a bore 30 into the mine shaft roof 28, typically of a diameter of 27-28 mm to a depth of up to 100 mm shorter than the length of cable 11 being used (as noted above, cable lengths typically may be in the range of 4 m-10 m).

The drill bit is then removed from the bore 30 and a known bonding material container inserted therein. The container contains a bonding material in the form of a two part resin, each part of which is kept separate from the other while in the container.

The abutment plate 24 is placed over the cable bolt and against the end of the housing 18. The cable bolt 11 with assembly 10 attached is then inserted into the bore 30, after the container, with the drilling rig connected to the drive head 22. The shaft is then pushed axially against the container in the bore 30. The pressure of the rotating shaft 12 against the container is such that the container is then fractured. The shaft 12 is then continually moved axially up through the fractured container and its continued rotation mixes the two components of the resin. Once the shaft 12 is fully inserted into the bore, rotation of the shaft 12 is then stopped and the shaft is maintained in its position in the bore 30 until the resin is set, bonding the shaft 12 to the bore 30. The shear pin 36 is configured to be strong enough to resist shearing during the above described process of rotating the shaft 12 to fracture the container in the bore 30 and to mix the two-component resin.

Once the resin is set, the drilling rig is used to drive the housing 18 further upon its hex drive head 22. Given that the shaft 12 is fixed in the bore 30 in the set resin, the force applied by the drilling rig on the housing 18 is such that the shear pin 36 shears allowing relative rotation between the housing and the barrel 14. Continued rotation of the housing 18 causes the barrel 14 with wedge 16 therein to travel from a first position (illustrated in FIG. 2) toward a second position (illustrated in FIG. 3) of the barrel 14 within the housing 18. In turn this forces the housing 18 upon the plate 24 providing a tensile force along the shaft 12. This in turn, as described above with respect to the prior art, provides a compressive force on the rock substrate 42 of the mine shaft roof 28 about the bore 30. The drilling rig can then be removed from the hex drive head 22 leaving the cable bolt 11 and tensioning assembly 10 in place on the mine shaft roof. As will be understood, the same process can be performed in various locations on the mine shaft roof 28 using a plurality of cable bolts 11 with tension assemblies 10 attached thereto.

Advantageously, the arrangement of the tensioning assembly 10 is such that the barrel 14, wedge 16 and housing 18 remain outside the bore 30. This means that the bore 30 can be sized to accommodate the shaft 12 only, and need not be enlarged over all or part of its length to accommodate the barrel 14, wedge 16 and housing 18. Therefore, as explained above, the resulting bonding between the resin, bore 30 and shaft 12 can be stronger than can be achieved by prior art methods. Also, providing a bore of fixed diameter along its length is more convenient than having to provide a bore with a relatively wider portion. The tensioning assembly 10 is also simpler to use than prior art methods and arrangements.

While the invention has been described in reference to its preferred embodiments, it is to be understood that the words which have been used are words of description rather than limitation and that changes may be made to the invention without departing from its scope as defined by the appended claims. For example, whereas the preferred embodiments have been described with reference to mining applications, it will be understood that it is not limited to this application. Also, whereas the preferred embodiment has been described with reference to a mine shaft roof, it will be understood that it could also be applied to a sidewall or base/floor.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

A reference herein to a prior art document is not an admission that the document forms part of the common general knowledge in the art.

The invention claimed is:

1. A tensioning assembly for a cable bolt having a flexible shaft, the assembly comprising:

a clamping device configured to mount to the bolt shaft, the clamping device having an axis that in use is aligned with the shaft axis;

an abutment device mountable to the bolt and arranged to be spaced from the clamping device in the direction of the shaft axis; and an outer member extending between the clamping device and the abutment device, the outer member being located over, and engaged with, the clamping device separating the clamping device from the abutment device in the direction of the clamping device axis and arranged, under a predetermined movement of the outer member, to impart drive to the clamping device to bias the clamping device to move in the direction of the clamping device axis away from the abutment device.

2. The tensioning assembly of claim 1, wherein the outer member is engaged with the clamping device through a threaded coupling with the clamping device having a threaded portion on an external surface thereof for threaded engagement with a corresponding internal threaded surface of the outer member and wherein the predetermined movement is rotation of the outer member relative to the clamping device.

3. A tensioning assembly according to claim 1, wherein the clamping device comprises a barrel and a wedge, wherein the wedge is directly connectable to the cable bolt and the barrel directly receives the wedge therein.

4. A tensioning assembly according to claim 3, wherein the wedge comprises a plurality of segments configured to clamp about a portion of the rock bolt when received together within the barrel.

5. A tensioning assembly according to claim 1, wherein the abutment device comprises an abutment plate mountable to the rock bolt and adapted to abut an end of the outer member.

6. A tensioning assembly according to claim 5, wherein the plate comprises a central boss defining an aperture therethrough for receiving the cable bolt, the boss being configured to engage with the end of the outer member.

7. A tensioning assembly according to claim 6, wherein the outer member is tapered from a distal end to a proximal end, the width of the aperture being smaller than a lateral width of the outer member at its distal end and larger than a lateral width of the outer member at its proximal end, the proximal end being configured to abut the boss.

8. A tensioning assembly according to claim 7, wherein the proximal end of the outer member is bull-nosed.

9. A tensioning assembly according to claim 1, wherein the outer member comprises a drive head thereon arranged to be driven by a drive apparatus to impart the predetermined movement on the outer member.

10. A tensioning assembly according to claim 1, further comprising a restraining device adapted to inhibit the predetermined movement until a threshold loading is applied to the outer member.

11. A tensioning assembly according to claim 10, wherein the restraining device comprises a shear pin which is arranged to shear when a predetermined torque is applied between the outer member and the clamping device.

12. A tensioning assembly according to claim 10, wherein the restraining device comprises a cap positionable within the housing and configured to be released from the outer member when a predetermined relative torque is applied between the outer member and the clamping device.

13. A cable bolt assembly comprising a flexible cable bolt shaft and having a first end arranged in use to be anchored in a bore formed in rock strata and a second end arranged to be disposed outside the bore, and a tensioning assembly according to claim 1, wherein the clamping device of the tensioning assembly is mounted to the cable bolt shaft proximate the second end and the outer member is arranged, under the predetermined movement, to impart drive to the clamping device to bias the cable bolt shaft to move in the direction towards the second end.

14. A method of tensioning a cable bolt in a bore formed in rock strata, the cable bolt having a shaft and a first end disposed in the bore and a second end disposed outside the bore, the method comprising the steps of:

providing a tension assembly on the cable bolt shaft, the tension assembly having a clamping device mounted on the shaft, an outer member engaged with the clamping device, and an abutment device spaced from the clamping device, the outer member extending between the clamping device and the abutment device separating the clamping device from the abutment device in the direction of the clamping device axis;

anchoring the cable bolt within the bore; and driving the outer member to impart a predetermined movement on the outer member, whereby under the predetermined movement, the cable bolt shaft is caused to move in a direction away from the rock strata to tension the cable by imparting drive to the clamping device to move in the direction of the axis of the cable bolt shaft towards the second end.

15. A method according to claim 14, wherein the clamping device is mounted to the outer member by a threaded coupling and the predetermined movement is rotation of the outer member relative to the clamping device.

16. A method according to claim 15, wherein the clamping device and the outer member rotate together until a threshold torque is applied to the tension assembly and thereafter the outer member is able to rotate relative to the clamping device.

17. A method according to claim 14, wherein the tension assembly is disposed outside the bore.

18. A method according to claim 17, further comprising the step of causing the outer member to bear either directly or indirectly against the outer face of the rock strata.

19. A method according to claim 18, wherein the outer member bears against rock strata through an abutment plate.

20. A method according to claim 14, further comprising the step of imparting the predetermined movement to the outer member via a drive head on the outer member.

21. A method according to claim 14, wherein the cable bolt is rotated within the bore to activate anchoring of the cable bolt in the bore.

22. A method according to claim 21, wherein the cable bolt is rotated by rotation of the outer member.

23. A method according to claim 14, wherein the bore is of constant diameter throughout its length.

24. A method according to claim 23, wherein the cable bolt is provided in a bore having a diameter that is less than 30% larger than the diameter of the cable bolt shaft.

25. A tensioning assembly for a cable bolt having a flexible shaft, the assembly comprising:

a clamping device configured to mount to the bolt shaft, the clamping device having an axis that in use is aligned with the shaft axis and comprising a barrel and a wedge, wherein the wedge is directly connectable to the cable bolt and the barrel directly receives the wedge therein;

an abutment device mountable to the bolt and arranged to be spaced from the clamping device in the direction of the shaft axis; and an outer member extending between the clamping device and the abutment device, the outer member being located over, and engaged with, the clamping device and arranged, under a predetermined movement of the outer member, to impart drive to the clamping device to bias the clamping device to move in the direction of the clamping device axis away from the abutment device.

26. A tensioning assembly according to claim 25, wherein the wedge comprises a plurality of segments configured to clamp about a portion of the rock bolt when received together within the barrel.

* * * * *